United States Patent [19]

Cieplik

[11] 4,158,496

[45] Jun. 19, 1979

[54] DRY SILVER PROCESSOR FOR PHOTOTYPESETTERS

[75] Inventor: Ronald J. Cieplik, Mountain Lakes, N.J.

[73] Assignee: AM International, Inc., Los Angeles, Calif.

[21] Appl. No.: 910,854

[22] Filed: May 30, 1978

[51] Int. Cl.[2] ..... G03D 3/13

[52] U.S. Cl. ..... 354/319; 355/27; 226/33; 226/118

[58] Field of Search ..... 354/299, 319; 226/33, 226/91, 118; 355/27, 28, 29

[56] References Cited

U.S. PATENT DOCUMENTS

| | | | |
|---|---|---|---|
| 3,613,976 | 10/1971 | Guerrero et al. | 226/118 |
| 3,630,468 | 12/1971 | Christofferson et al. | 226/91 |
| 3,724,945 | 4/1973 | Masiello | 355/29 |
| 4,021,110 | 5/1977 | Pundsack | 355/27 |

*Primary Examiner*—L. T. Hix
*Assistant Examiner*—Alan Mathews
*Attorney, Agent, or Firm*—Robert S. Hulse; Michael A. Kondzella

[57] ABSTRACT

A processor for developing the encoded output medium of a business machine, wherein the processing rate is greater than the encoding production rate but must proceed uninterrupted once started. The medium, usually a web of paper or other film, is projected into the processor along a guided path to a set of drive rollers. When the web is firmly grasped by the drive rollers, the drive motion is caused to cease. The web continues to be delivered, however. The guided path is established by movable walls which will allow the incoming web to fan-fold by pushing the walls aside. The drive rollers are reactivated and the web separated from the source in a closely spaced time interval, so that the portion captured in the processor may then proceed through to a finished condition uninterrupted.

3 Claims, 4 Drawing Figures

DRY SILVER PROCESSOR FOR PHOTOTYPESETTERS

BACKGROUND OF THE INVENTION

Most output from photocomposition machines has been on wet process photographic paper. Photocomposition is undoubtedly the biggest use of encoded output medium in the business machine classification, and hence is used as an illustration of the invention.

The standard procedure has been to collect the exposed photographic film or paper in a light-tight cassette removably attached to the photocomposition machine, and the cassette physically transported to a separate developing machine where the paper is fed through a light-tight junction box from the cassette into the developer.

Dry process papers have been known for some period of time, but have never been widely adopted for photocomposition use until very recently. U.S. Pat. No. 3,457,075 illustrates the state of this art. Such dry silver papers are heat developed and are of good technical quality. Because there are no chemicals used to develop the dry silver paper, but rather the paper being developed solely by the application of measured amounts of heat, there is no necessity to separate the paper in the cassette from the production phototypesetter. However, the output from the phototypesetter is considerably slower than the speed at which the paper must be processed through a heat developer. Hence, it has been thought necessary to collect the paper and separately develop as done with the chemical processing papers.

SUMMARY OF THE INVENTION

This invention comprises a self-contained processor which can be retained as an integral part of a photocomposition machine with the output of the photocomposition machine collected internally of the processor throughout a discrete composition endeavor. At the end of the endeavor, the photocomposition paper is severed from the source roll, and at that time the developer switches to a developer mode and rapidly irons the paper across the shoe of a heat developer station and outputs the paper to the exterior of the processor cabinet.

A special feature of the present invention is the capability of alternate use of a cassette for the collection of wet development paper, and the installation on a temporary basis of the dry development processor.

DESCRIPTION OF THE PREFERRED EMBODIMENT

Figure 1:
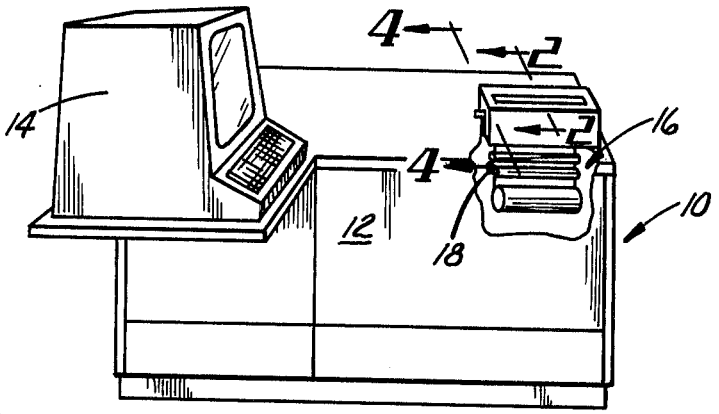
FIG. 1 is a front view of an Addressograph-Multigraph COMP/SET 500 brand photocomposition machine, with the development station broken away to show the installation of the present invention in the place of the prior wet development paper cassette.

This invention is suitable for service on any machine wherein a web of material which is encoded and must thereafter be developed through a processing station, may be collected and processed. However, it has been designed for first commercial use with an existing photcomposition machine indicated by the reference numeral 10 in the FIG. 1. This machine is currently manufactured and sold by Addressograph-Multigraph Corporation and employs a photo deck 12, which is the name applied to the cabinet containing the components of the machine other than a keyboard and video display 14.

Figure 2:
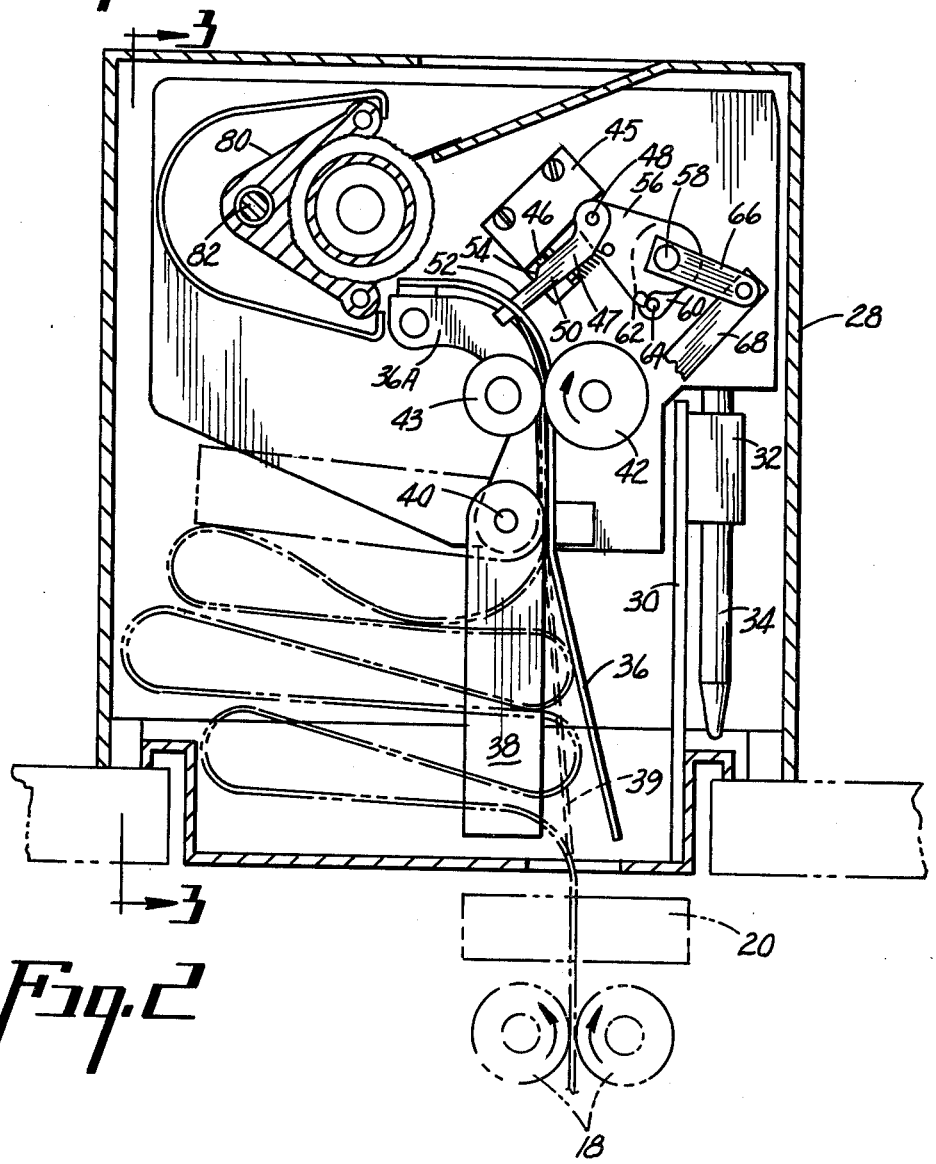
FIG. 2 is an interior view taken substantially along the line 2—2 of FIG. 1, showing the essential relationship of web drive roller means, and an expandable guide system to allow the accumulation of the web prior to development.
Figure 4:
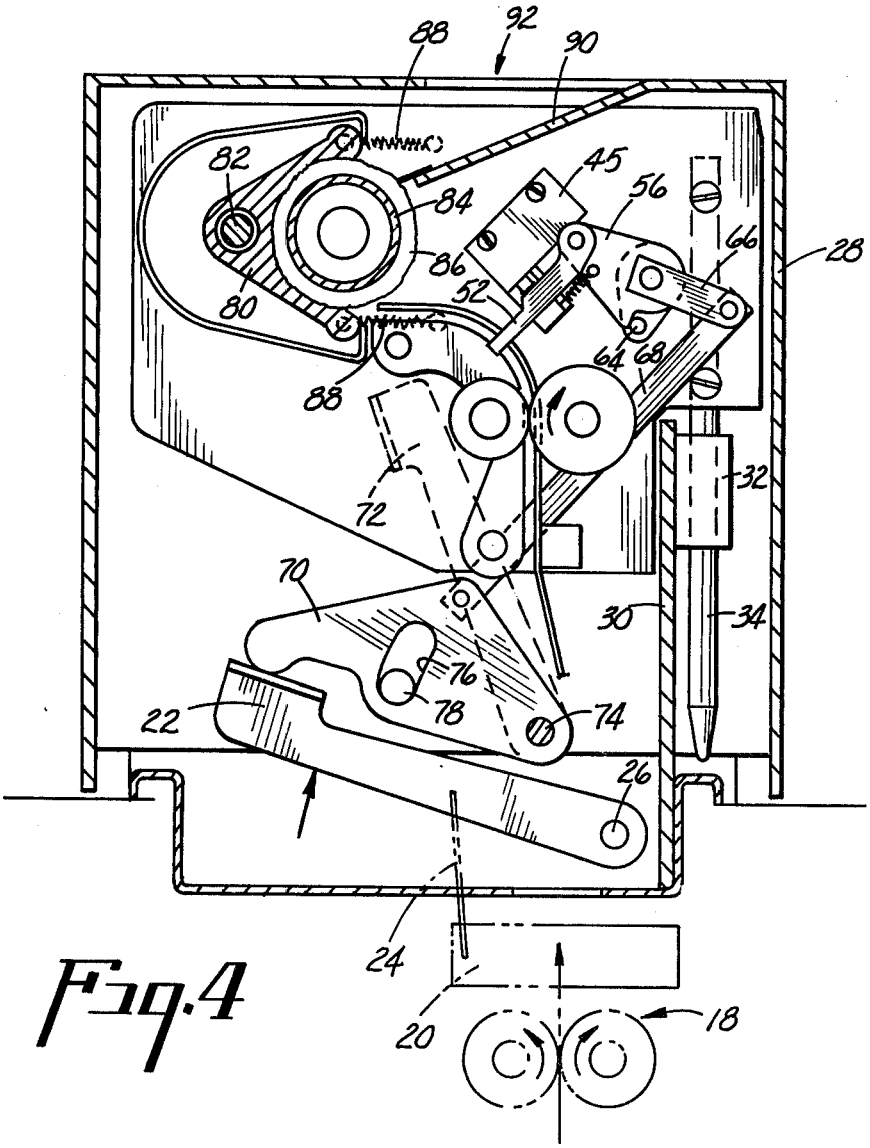
FIG. 4 is a section view taken along the line 4—4 of the FIG. 1.

Within the cabinet of the photo deck 12 is a paper supply cartridge 16, one form of which may be studied in detail in U.S. Pat. No. 3,724,945. The actual form of the paper supply cartridge is not shown in these drawings, and only a set of drive rolls 18 are used as symbolic representations of the output drive of such a paper supply cartridge. Refer to FIGS. 2 and 4. In this description, the drive rolls 18, coupled with a paper cutoff 20, constitutes the output of the photo deck 12 and will move a web in a regular procession as it is encoded. In this instance, the rolls 18 will advance the paper in increments representative of lines which have been exposed by the machine 10.

In the present commercial embodiment of the photocomposition 10, there is a manual drive on the exterior of the machine adjacent to and operating in conjunction with a configuration of the machine which may be termed a "saddle" into Paper collecting cassettes may be inserted into the saddle for accepting the encoded paper web from the machine photo deck 12. A chemically developed paper will be collected in a cassette which is simply a light-tight box which fits the saddle of the machine and allows the paper to coil within the cassette until the photocomposition has been completed. At that time, the operator presses a manual drive handle 22 which operates the cut-off 20. In FIG. 4, a symbolic link 24 shows a manual interconnection to the cut-off device. The actual structure is simple a connecting series of links and levers. The handle 22 is pivotally mounted on the cabinet of the photo deck 12 by means of a pivot 26. This structure is shown only in FIG. 4 of the drawing. It must be understood that the description of the invention is in the environment of a commercial machine wherein it is desired to make the output of the machine in either chemically or dry silver process paper. Therefore, some of the parts of the illustrated invention are simply adaptive parts to make that interchange readily available and are not essential to the invention. For example, if the present invention were to be a permanent part of a machine, there would be no need to keep normal manual drive 22 and cover it over within the housing 28, and then have the mechanism of this invention operate that handle 22. Rather, there would be a direct connection from parts later to be described.

Because this is an illustration of a practical, interchangeable device, a standard 30 is provided on the photo deck 12 at the saddle area and carries guide sleeves 32. The housing 28 of the processor shown in the drawings then carries a plurality of pins 34 which have tapered ends to enable facile location of the pins into the sleeves 32 and to guide the housing 28 into proper light-tight relationship to the saddle area of the photo deck housing. Light seals are of conventional felt interfitting surfaces and no effort has been made to show such seals in detail, because such light-tight fittings are well known in the photographic art.

Figure 3:
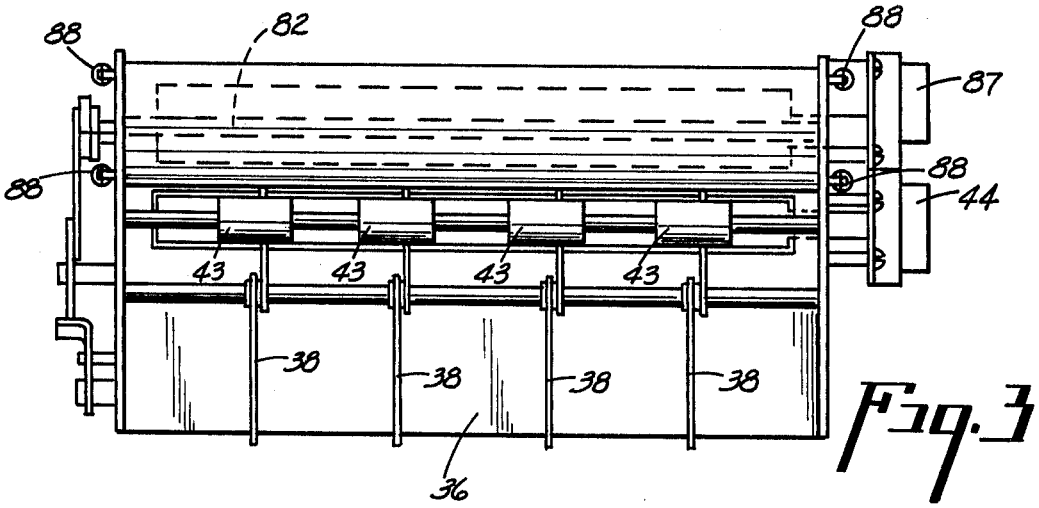
FIG. 3 is a view of the processor taken substantially along the line 3—3 of FIG. 2.

Referring more specifically to FIG. 2, with some reference to the FIG. 3, a guide system means is shown for directing the web from the drive rolls 18 into proper relationship within the processor of this invention. A guide 36 extends from a point adjacent the entry area of the web from the photo deck and extends upwardly to a region where the actual heat developer is located. In this instance, the guide 36 ends in a distinctively curved path.

Cooperating with the guide 36 is a second guide 36*a*. Guide 36 and guide 36*a* jointly form a guide channel over a portion of the guide system, but only the guide 36 extends fully to the receiving area of the web as a fixed and permanent guide surface.

A unique feature of the present invention is embodied in the provision of a plurality of gravitationally oriented pendant fingers 38. In FIG. 3 there are shown four such fingers in the present embodiment of the invention. These fingers are light in weight, but assist in directing the lead edge of the web along a delivery path, indicated by the dotted outline extension of the web in FIG. 2, reference numeral 39. There is no great pressure on the web to leave the path 39 as it enters the processor, but the pendant fingers 38 assure that the web enters into the guide channel. Fingers 38 are swingable on pivot hangers 40.

Drive roll 42 and an idler roll 43 cooperate with one another as a threshold web feed drive means. Openings in the guide system allow the rollers 42 and 43 to contact one another in a bite which will accept the lead end of a web fed into the guide system. A motor 44, seen in FIG. 3, drives the roll 42 at a constant speed which is calculated to move a web through the guide system and into the heat processing portion of the processor at a speed which is calculated to be the optimum for proper dry development of the web. However, that speed is far greater than the speed which normally can come from the photo deck 12 as the composition proceeds, even at the highest output of the photocomposition machine. However, if the output from the photocomposition machine were of a speed equal to the processing speed, nevertheless, the operator of the photocomposition machine may stop in the mid-portion of the composition for any reason and the output of the machine would then cease. Therefore, it is not feasible to have the output of the photocomposition machine enter directly into the processing step which requires a constant speed through a heat station for development.

Accordingly, a switch 45 is placed in a circuit which controls the motor 44. A pin 46 is shown protruding from the switch 44, and a slide actuator 47 mounted by a pivot 48, is shown pressing the switch pin 46 inwardly to deactivate the motor drive. The actuator 47 is pivotally mounted by a pin 48, and projects through an opening to cross the guide system channel. The web of material coming from the phototypesetter is captured by the drive roll 42 and the idler 43, and driven against the end of the actuator to force the pin 46 to the illustrated position to deactivate the drive motor of the roll 42. Thus, the web of paper remains captured in the bite of the rolls 42 and 43, but the drive action is brought to a halt.

The actuator 47 is shaped with a large body portion 50 and a reduced finger end 52 with a shoulder 54 therebetween. Accordingly, by withdrawing the actuator 47 in the direction of pivot 48, the pin 46 is permitted to drop down at the shoulder 54 and rest against the more narrow finger end 52. When pin 46 is thus allowed to extend, the switch will make the circuit to reactivate the drive motor 44 and advance the web in the guide system channel.

After capture of the lead end of the web and contact of that web against the actuator 47 to stop the drive roll 42, the photocomposer drive rolls 18 continue to feed paper as photocomposition continues. Since the lead edge is captured and held stationary, the paper will tend to buckle between the pendant fingers 38 and the fixed guide 36. Because the fingers 38 are of light weight and hanging pivotally from the pivot pin 40, fan folding of the web in the manner illustrated in FIG. 2 takes place. As the web continues to enter the processor the fingers are progressively forced to the dotted line position shown in FIG. 2 and thereby allow the fan folding to take place in the expansible storage chamber which is provided thereby for collecting the exposed web delivered to the processor after the means for driving the web has been shut down.

After the photocomposition has been completed the web is severed and processed. The slide actuator 47 is the control agent for starting and stopping the drive motor for the roll 42 as described. The actuator is withdrawn to the shoulder position for reactivating the motor whenever the operator causes the web to be severed. This movement is accomplished by a mechanical linkage means in the illustrated embodiment of the invention. The linkage to do this operation mechanically comprises generally a first drive link 56 to which the pivot 48 is attached. A spring 49 urges the link to extend the actuator toward its interference position. The link 56 is pivoted about a pivot pin 58 which also carries a second drive link 60. Drive link 56 has a shoulder 62 which is in position to be contacted by a drive pin 64 carried by the link 60. A lever arm 66 is in driving engagement with the pivot 58, and when rotated to drive link 60 in a clockwise direction, the pin 64 will contact the shoulder 62 and cause pivot 48 to draw the actuator 47 into the position wherein the switch pin 46 may drop from the shoulder 54 and start the drive of the rollers 42.

A connecting link 68 seen partially severed in FIG. 2, is better illustrated in FIG. 4. The connecting link 68 is extended downwardly in the housing until it connects with a drive cam 70. Cam 70 is positioned to contact the finger pad of the normally exterior manual drive 22, which is captured within the housing 28 in the dry processor illustrated.

The cam 70 is pivotally mounted on a rod 74 and the rod 74 in turn is driven by an external handle 72 (see only in phantom) carried by the housing 28. Whenever the external handle 72 is depressed, the cam 70 is rotated about pivot point 74 to actuate the hidden normally exterior drive handle 22 and, through the link 24, cause a cut-off of the web.

The drive cam 70 is provided with a limit slot and limit pin 78 to permit the cam to move only through necessary excursions without undue overdrive. By rotating the cam 70 counterclockwise, the connecting link 68 causes rotation of the drive links 60 and 56 to withdraw actuator 47 and commence operation of the roll drive 42. Hence, cutting of the web begins operation of the processing step, and the web is fed at a continuous regular speed through the processing step.

It should be observed that the mechanical linkage, including the capture of a normally exterior handle is an optional and convenient manner of providing the function of the present invention, but that electrical and electromechanical devices are completely within the scope of carrying forth the severing and paper process steps. As an example, it is contemplated that a permanently mounted dry processor may be completely controlled by keys on the keyboard of the video display 14. The adaptation of a the peripheral systems in no way effects the novel concept of capture of the web and allowing it to gather in an expansion chamber and thereafter processing the web at a continuous rate.

The dry silver material is heat processed by the provision of a heated shoe 80 that is kept at a uniform temperature by a heating element 82. A thermostatic control is provided but not illustrated because these controls are old and well known in the art.

A cylindrical roller 84 has a soft nap cover 86 and is driven by a motor 87 at a constant speed in order that the web of material which is fed to the heated shoe through the guide system means may be uniformly and fully developed to its clearest and best contrast.

The drive speed of the roller 84 is slightly greater than the drive of rollers 42–43 will permit, in order to prevent buckling of the web. However, slight slippage in the heater shoe is acceptable.

A set of springs 88 urges the heated shoe against the nap cover 86 in order to press the web tightly against the hot ironing surface as processing proceeds.

A guide 90 at the top of the processor acts as an exit shute where the developed web is directed through an opening 92 to the exterior where it is accessible to the operator.

What is claimed is:

1. A processor for development of a latent image in a developable encoded web wherein a primary encoder machine has a web feed means to drive the web in a regular procession as it is encoded; comprising:

development means through which the web must be fed at a uniform lineal speed, said means including means for driving a web therethrough;

a threshold web feed means;

a guide system means for directing a web from said threshold feed means to the means for driving the web through the development means;

means for detecting the presence of a web in said guide system means and for shutting down said threshold web feed means in response thereto;

an expansible storage chamber for collecting exposed web delivered to the processor after said threshold web feed means is shut down, and means to override said means for detecting the presence of a web and reactivate said threshold feed means, thereby delivering the web to the means for moving a web through the development means.

2. A processor as defined in claim 1 wherein the feed speed for the means for moving the web through the development is close to but faster than the speed of the threshold web feed means, whereby the web will not buckle in the guide system.

3. In a processor as defined in claim 1, said expansible storage chamber for collecting exposed web being defined by a guide system with at least a portion of the guide system being displaceable by the incoming web as it attempts to buckle and fan fold.

* * * * *